US007181802B2

(12) United States Patent
Kosick

(10) Patent No.: US 7,181,802 B2
(45) Date of Patent: Feb. 27, 2007

(54) DEVICE FOR APPLYING PAINT ONTO SURFACES

(76) Inventor: Günther Kosick, Mittelmähder 17, 86707 Kühlenthal (DE)

( * ) Notice: Subject to any disclaimer, the term of this patent is extended or adjusted under 35 U.S.C. 154(b) by 178 days.

(21) Appl. No.: 10/320,369

(22) Filed: Dec. 17, 2002

(65) Prior Publication Data

US 2003/0126712 A1 Jul. 10, 2003

(30) Foreign Application Priority Data

Jan. 8, 2002 (DE) ..... 202 00 195 U
Jan. 8, 2002 (DE) ..... 202 00 196 U

(51) Int. Cl.
*A46B 17/00* (2006.01)
*B05C 21/00* (2006.01)

(52) U.S. Cl. ..... 15/248.2; 15/230.11

(58) Field of Classification Search ..... 15/230.11, 15/248.2

See application file for complete search history.

(56) References Cited

U.S. PATENT DOCUMENTS 2,835,915 A * 5/1958 Pearson ..... 15/248.2
3,457,582 A * 7/1969 Fisher ..... 15/248.2
4,593,428 A * 6/1986 Calvert ..... 15/248.2
5,539,950 A * 7/1996 Zar et al. ..... 15/248.2
5,864,918 A * 2/1999 Kosick ..... 15/248.2
5,960,511 A * 10/1999 Boyce ..... 15/248.2

* cited by examiner

*Primary Examiner*—Randall Chin
(74) *Attorney, Agent, or Firm*—Bacon & Thomas

(57) ABSTRACT

With a device for applying paint onto surfaces, especially ceilings and/or walls, comprising an applicator roll (1) rotatably supported on a bracket (2) fitted onto a stick (3), and a drip cup (5) associated to the applicator roll (1) and fitted displacably onto the stick, said drip cup comprising an opening (7) traversed by the stick (3) and a pipe socket (8) projecting from the opening and enclosing the stick (3) but being shorter than said stick (3), the drip cup (5) being retractable from a working position in which it encloses the stick-sided peripheral area of the applicator roll (1) to a release position in which the applicator roll (1) is pushed out of the drip cup (5), and vice-versa, a simple and easily applicable construction may be achieved in that the drip cup (5) is supported on the stick (3) in a self-locking way by a frictional force which may be overcome manually.

13 Claims, 3 Drawing Sheets

DEVICE FOR APPLYING PAINT ONTO SURFACES

FIELD OF THE INVENTON

The invention refers to a device for applying paint onto surfaces, especially ceilings and/or walls, comprising an applicator roll rotatably supported on a bracket fitted onto a stick, and a drip cup associated with the applicator roll and fitted displacably onto the stick The drip cup comprising an opening traversed by the stick and a pipe socket projecting from the opening and enclosing the stick but being shorter than the stick, the drip cup being retractable from a working position in which it encloses the stick-sided peripheral area of the applicator roll to a release position in which the applicator roll is pushed out of the drip cup, and vice versa.

BACKGROUND OF THE INVENTION

A device of the type noted above is known from U.S. Pat. No. 5,864,918. With this known arrangement the drip cup is retractable from the working position against the force of a restoring spring. Therewith, the restoring spring is arranged within the stick formed as a tube and fixed on the one hand at the end of the stick being distant from the applicator roll and on the other hand it is supported by a lug being fixed at the pipe socket enclosing the stick, and traversing a slot of the stick. For avoiding an undesired reset of the drip cup it may be locked in the retracted release position by means of a locking device. The restoring spring arrangement and the locking device result in a relatively complicated and expensive construction without achieving an essential advantage in the handling. Besides, there is the danger that the drip cup bounces uncontrolledly to the working position in case of an unintended actuation of the locking device. Thus, the known arrangement proved to be not simple and reasonable enough.

SUMMARY OF THE INVENTION

Thus, proceeding from this it is an object to be solved by the present invention to improve a device of the known kind with simple and cost-effective means in such a way that a simple and cost-effective construction and a simple and clear operability are ensured.

The drip cup may be pushed in any desired position simply by overcoming the frictional force and is subsequently kept in friction contact in the respective position. The actuation and release, of a locking device is here not necessary. A restoring spring and a locking device may be omitted. Thus, the inventive measures enable advantageously an extremely simple and cost-effective construction as well as a high comfort of use.

Advantageous embodiments and practical modifications of the generic measures are indicated in the discussion that follows. Thus, the pipe socket may practically be provided in the area of its rear end with a conical reduction and slots parallel to the axis. In this way, lugs resiliently contacting the stick are obtained which may generate the desired frictional force. If an increase of the frictional force generated in such a way is desired an annular spring may be provided enclosing the pipe socket in the slotted area.

For avoiding leakage a wiper ring contacting the stick may be provided in the area of the opening of the drip cup being traversed by the stick. However, in most cases it is sufficient if the inner periphery of the pipe socket sits close to the outer periphery of the stick.

According to a further modification of the generic measures, a shrinkable tubing formed as a handle may be accomodated on the pipe socket. Hereby, the danger of injuries etc. may effectively be avoided and reliable pressing forces may be obtained.

Further advantageous embodiments and practical modifications of the generic measures may be taken in detail from the following description by means of the drawings.

DESCRIPTION OF THE PREFERRED EMBODIMENTS

Figure 1:
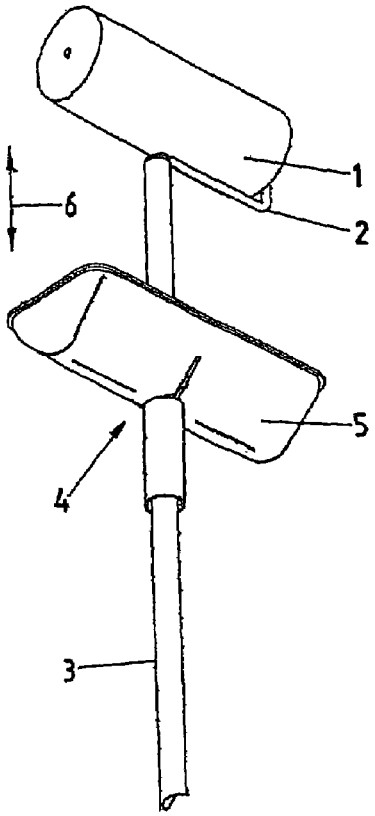
FIG. 1 is a perspective view of an inventive application device having an applicator roll being pushed out of the drip cup.

The paint application device which may be seen in FIG. 1 consists of an applicator roll 1 comprising a coating made of textile material which is rotatably supported in a known manner on a bracket 2 formed by a curved round bar etc. which is attached to the front end of a rod-like stick 3, e.g. threaded into a stick-sided screw socket by means of a threaded part. The stick 3 results in a large range of action. By means of the stick 3 it is possible e.g. to apply paint onto the ceiling and high walls of a room, by standing on the floor.

With such works paint drops thrown off from the applicator roll may result because of the rotation of the applicator roll 1 and because of the pressing force of the applicator roll 1. For collecting them and for avoiding soiling of the surroundings a splash guard device is associated with the applicator roll generally designated as 4.

The splash guard device comprises a drip cup 5 displaceably supported on the stick 3 and being retractable according to the double-headed arrow 6 from a working position which is here not shown in detail and enclosing the stick-sided peripheral area of the applicator roll 1, to the release position shown in FIG. 1 in which the applicator roll 1 is pushed out of the drip cup 5, and vice versa. During the application of paint onto the ground the drip cup is in the working position enclosing the stick-sided peripheral area of the applicator roll 1 with sufficient clearance. For immersing the applicator roll 1 into a paint reservoir the drip cup 5 is moved to the release position shown in FIG. 1.

Figure 2:
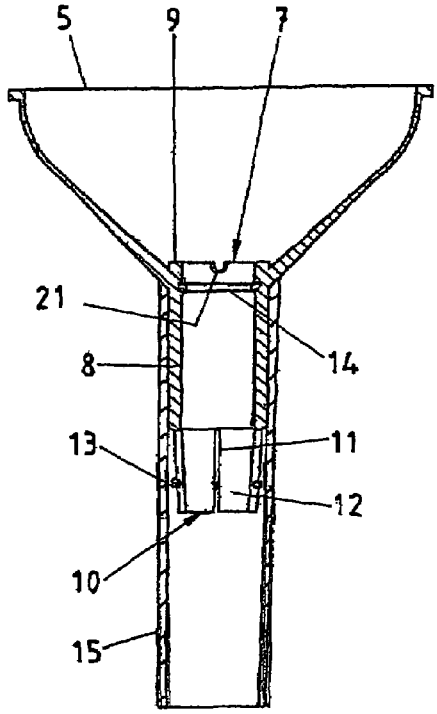
FIG. 2 is a cross-section through the drip cup.
Figure 3:
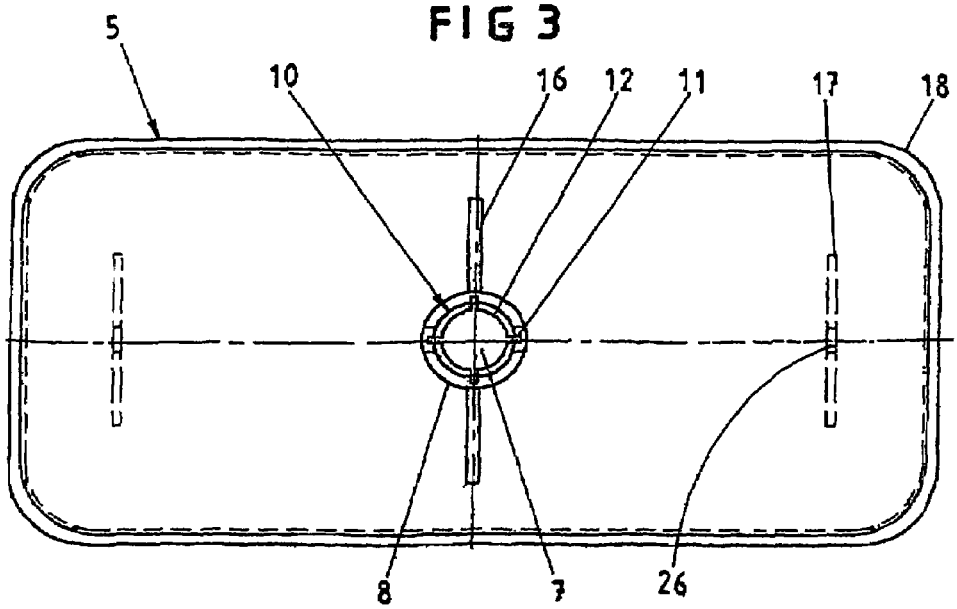
FIG. 3 is a plan view onto the bottom side of the drip cup.

The drip cup 5 comprises, as is shown in FIGS. 2 and 3, a bottom-sided opening 7 which may be traversed by the stick 3. From the edge of the opening 7 a pipe socket 8 moulded at the drip cup 5 is projecting downwardly through which the stick may also be inserted. The pipe socket 8 only has a length of several centimeters and therewith it is substantially shorter than the stick 3 so that a sufficient degree of displacement is obtained. With the illustrated embodiment, a collar 9 is provided formed as an extension of the pipe socket 8, projecting into the inner space of the drip cup 5 and surrounding the opening 7 which may stiffen the opening area.

Figure 4:
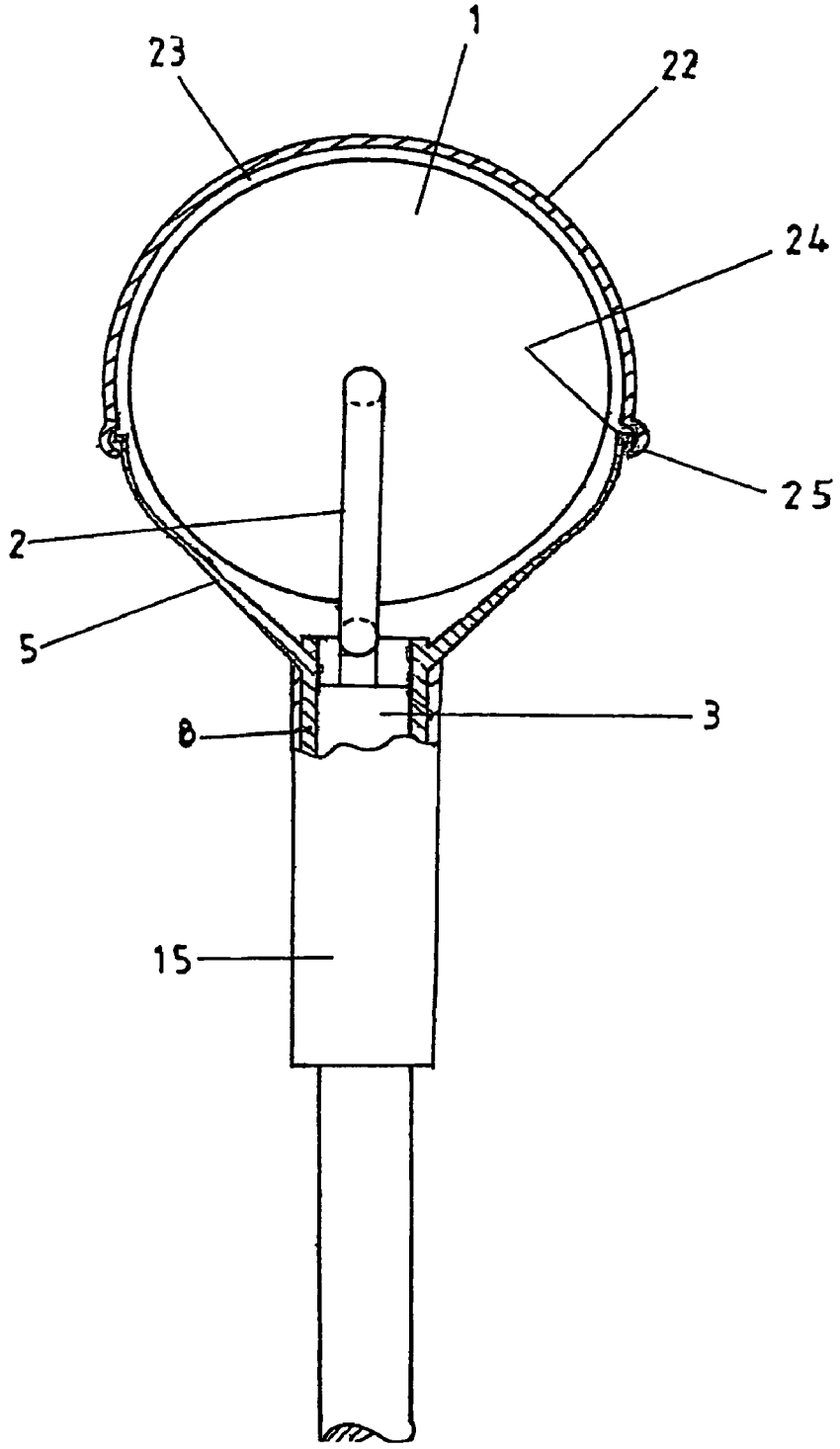
FIG. 4 is a vertical section through the inventive arrangement comprising a drip cup being closed by a cap.

The collar 9 may be provided with upwardly open notches 21 opposingly aligned with each other in the longitudinal direction of the drip cup 5 with which the bracket 2 carrying the applicator roll 1 may engage with a portion adjacent to the stick 3 if the drip cup 5 is lifted upwardly, as may e.g. be seen from FIG. 4. Hereby a mutual rotatability between the applicator roll 1 and the drip cup 5 is avoided ensuring an especially high reliability and safety.

For achieving the desired frictional force between the stick 3 and the pipe socket 8, the pipe socket 8 may be formed at least over a part of its length sifting closely with its inner periphery on the outer periphery of the stick 3. Practically, a spring device may be provided for achieving the desired frictional force resulting in a resilient mutual contact so that also with robust operating conditions it is ensured that no troubles will arouse.

With the illustrated embodiment, the pipe socket 8 is hereto provided with a conically reduced extension 10 in the area of its rear end. In the area of the conically reduced extension 10 slots 11 arranged parallel to the axis are provided so that spring shackles 12 are obtained, which are limited by the slots. If the spring shackles 12 do not provide the desired frictional force, an annular spring 13 surrounding them may additionally be provided. It may also be installed subsequently if the spring shackles 12 should tire in the course of time.

Since the drip cup 5 does not serve as a paint reservoir but only as a splash guard relatively less paint is in the drip cup so that there is no remarkable danger of paint leakage via the slot between the stick 3 and the pipe socket 8. Additionally, the collar 9 projecting into the inner space of the drip cup 5 may prevent paint collected at the bottom from flowing over into the slot. The collar 9 acts accordingly as a retaining weir. For achieving additional safety, a wiper ring 14 may be provided in the area of the opening 7 which may sit close to the stick avoiding a slot for passage of the paint. Such a wiper ring 14 may at the same time generate the desired frictional force and increase it.

The pipe socket 8 formed as one part with the drip cup 1 may be formed as a handle. In the illustrated embodiment a cover 15, preferably formed as a shrinkable tubing, is pushed on the pipe socket 8, the cover being formed as a handle and exerting at the same time radial tension forces by which the spring shackles 12 may be pressed against the stick 3 for achiveing the desired frictional force so that the annular spring 13 mentioned above may possibly be omitted. Besides, dangerous areas in the form of the slotted extension 10 and the like are covered by the cover. The length of the cover 15 is dimensioned in such a way that it may well be gripped by hand. Therefore, a length of at least a hand's breadth is sufficient.

The construction element forming the drip cup 5 with the pipe socket 8 moulded to it may practically be produced as a plastic injection moulded article. The cover 15 is subsequently fitted. Therewith, a close sitting may be provided resulting in a clamp mounting. The cover 15 may also be fixed by glueing etc.

For protecting the applicator roll 1 from drying during longer working breaks and interruptions, the drip cup 5 may be associated with a detachably mountable cap 22, as may be seen from FIG. 4, which is put onto the drip cup 5 if necessary. This results in a closed housing having an internal space 23 accomodating the applicator roll 1 so that the applicator roll 1 may not become dry over a longer period. This avoids washing of the applicator roll 1 with every interruption of the work.

The cap 22 is practically detachably mountable at the drip cup 5 by means of a clip or snap-on fastener similar to keep-fresh boxes used in the household. With the illustrated embodiment the drip cup 5 is provided therefor with an outwardly projecting peripheral shoulder 24. The cap 22 comprises a peripheral shoulder 25 having a claw-shaped cross-section in which the shoulder 24 of the drip cup 5 may snap in. For facilitating the snap-in process the drip cup 5 and/or the cap 22 may consist of a flexible material. Both parts cooperating like upper and lower parts of a two-part housing may be formed as plastic injection moulded articles.

In the position shown in FIG. 4, the applicator roll 1 is moved into the drip cup 5 and therewith protected against rotation by engagement of the bracket 2 with one of the notches 21 so that contact with the inner wall of the housing accomodating the roll is avoided.

For achieving a high rigidity of the drip cup 5 it is provided at its lower outer surface with stiffening ribs 16 extending from the pipe socket 8. As shown in FIG. 3, in the lateral edge areas transverse ribs 17 may be provided in the inner space of the drip cup 5. Every one of them is provided with a notch 26 being upwardly open and aligned with the notches 21 of the collar 9 with which the bracket 2 may be engaged in the working position. The upper side of the transverse ribs 17 may have a course following the bottom of the drip cup 5. The drip cup 5 is provided with a peripheral shoulder 18 in the area of its upper edge.

Figure 5:
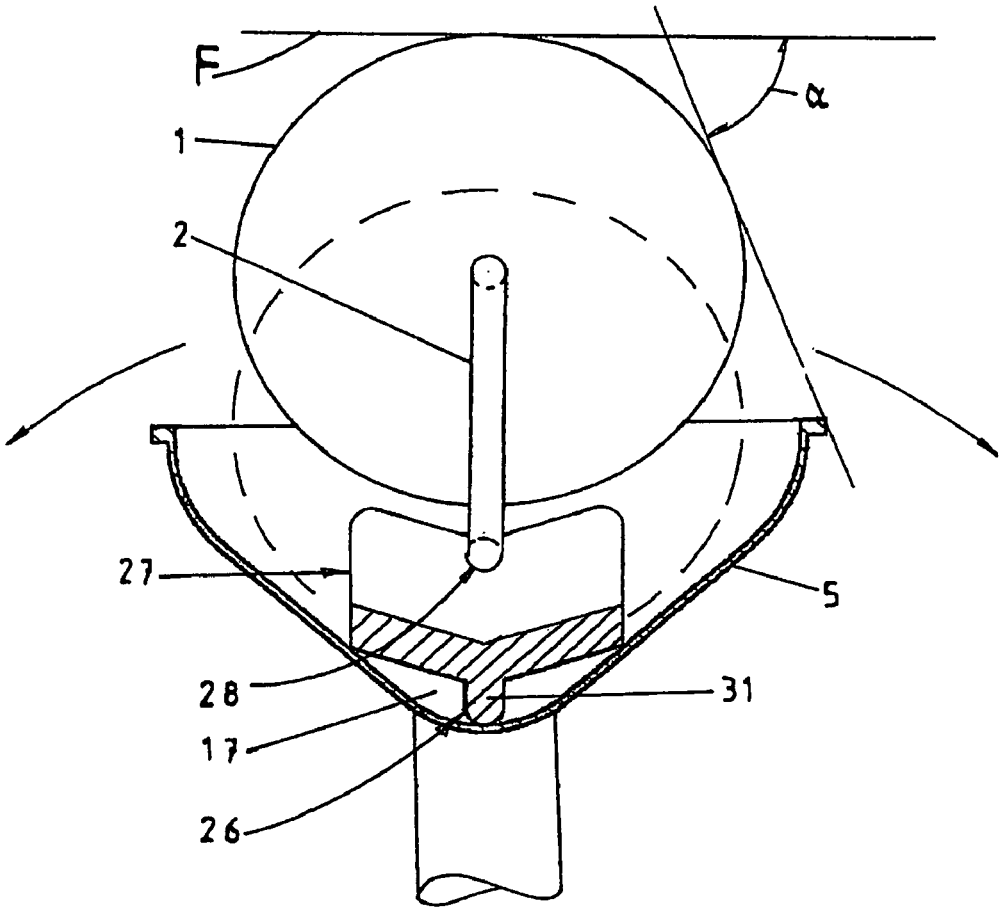
FIG. 5 is a cross-section through the application device having a stop element being arranged in the drip cup and enlarging the distance between the cup and the applicator roll.

FIG. 5 shows further practical accessories for the drip cup 5. With the arrangement according to FIG. 5, a saddle 27 is stuck onto at least one of the inner transverse ribs 17, the saddle having at its upper edge a central notch 28 engaging with the bracket 2 carrying the applicator roll 1 with its portion extending towards the stick 3 in the working position, i.e. if the drip cup 5 is lifted up to the applicator roll 1. The saddle 27 forms a stop functioning in that the applicator roll 1 further projects from the drip cup 5 in the working position than in case of non-use of the saddle 27, as may well be seen by comparing the position of the applicator roll 1 using the saddle 27 which is drawn with a continuous line in FIG. 5, with the position of the applicator roll 1 without a saddle 27 which is drawn in FIG. 5 in broken lines.

Where the applicator roll 1 projects relatively far from the drip cup 5, the applicator roll 1 may contract a relatively large peripheral area of the surface to be painted, indicated in FIG. 5 by F, without the drip cup 5 touching the surface F with its edge as is indicated by the angle .alpha. Thus, the whole application device may be pivoted by a relatively big angle shown in FIG. 5 by double-headed arrows so that the user of the inventive device has a big range of action. However, the drip cup still protects from spattering.

Figure 6:
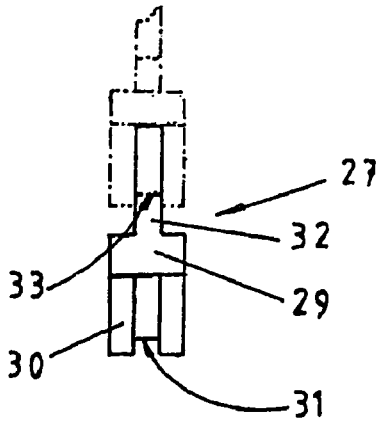
FIG. 6 is a side view of the stop element.

The saddle 27 comprises, as may be seen from FIG. 5 in connection with FIG. 6, a yoke 29 which may be supported on the the upper edge of the associated transverse rib 17 of the drip cup 5 from which two legs 30 flanking the associated transverse rib 17 project downwardly. They are connected with each other by a web 31 associated to the notch 26. The edge of the legs 30 being distant from the web may have a course adapted to the inner contour of the drip cup 5 resulting in a reliant fitting. At the side opposite to the legs 30 a lug 32 is provided projecting from the web 31 upwardly and being arranged centrally, the lug being provided at its upper edge with a central notch 33. The thickness of the lug 32 approximately corresponds to the thickness of the transverse ribs 17. The inside distance of the legs 30 is dimensioned in such a way that a slight clamping action and therewith a good seat is achieved if they are clipped onto the associated transverse rib 17.

It is sufficient if one saddle 27 of the kind described above forming a stop is associated with a transverse rib 17, namely the rib being below the area of the bracket 2 extending to the stick 3. Practically both transverse ribs 17 may be provided with saddles 27 so that the user must not pay attention to the fact that the bracket 2 projects laterally to said saddle.

If the applicator roll 1 shall project extremely far from the drip cup 5 a further saddle 27 may be clipped onto the first saddle 27 clipped onto a transverse rib 17 of the drip cup as is indicated in FIG. 6 in dash-dotted lines. For this reason too, it is advantageous if the drip cup 5 is provided with a set of at least two saddles 27.

What is claimed is:

1. A device for applying paint onto surfaces, comprises: a stick; a bracket fitted on said stick; an applicator roll rotatably supported on said bracket; a drip cup associated with said applicator roll and fitted displacably onto said stick; and a spring device operatively associated with said drip cup, wherein: said drip cup comprising an opening traversed by said stick, and a pipe socket projecting from said opening and enclosing said stick, said pipe socket being shorter than said stick; said drip cup is retractable from a working position in which it encloses a stick-sided peripheral area of the applicator roll to a release position in which the applicator roll is pushed out of said drip cup, and vice-versa; said drip cup is supported on said stick in a self-locking way by a frictional force which may be overcome manually and said pipe socket is provided in the area of its rear end with a conically reduced extension, said conically reduced extension is provided with slots, which extend parallel to the longitudinal direction of said stick, and being surrounded by said spring device.

2. A device according to claim 1, wherein: said stick has an outer periphery, and said pipe sockets sitting close with its inner periphery over at least a part of its length on said outer periphery of said stick, is provided with an elastic reduction.

3. A device according to claim 1, further comprising: a wiper ring, wherein: in the area of the opening being traversed by said stick, said wiper ring is provided sitting close to said stick.

4. A device according to claim 1, wherein: said pipe socket is associated with a shrinkable tubing accommodated on said pipe socket and being formed as a handle.

5. A device according to claim 1, further comprising: a detachable cap, wherein: said drip cup is associated with said detachable cap with which said drip cup forms a closed housing accomodating said applicator roll.

6. A device according to claim 5, wherein: said drip cup comprises an outwardly projecting peripheral shoulder; and said detachable cap comprises a peripheral shoulder having a cross-section which may be snapped on said outwardly projecting peripheral shoulder.

7. A device according to claim 5, wherein; said drip cup comprises an outwardly projecting peripheral shoulder; and said detachable cap comprises a peripheral shoulder having a claw-shaped cross-section which may be snapped on said outwardly projecting peripheral shoulder.

8. A device according to claim 1, wherein: in said drip cup at least one stop element is associated with said bracket supporting said applicator roll, said at least one stop element is detachably fixed as a result of which the distance between said applicator roll and said drip cup is enlarged in a working position.

9. A device according to claim 1, wherein: said drip cup is provided in a lower area with outer stiffening ribs extending from said pipe socket.

10. A device according to claim 1, wherein: said spring device produces the frictional force.

11. A device for applying paint onto surfaces, comprises: a stick; a bracket fitted on said stick; an applicator roll rotatably supported on said bracket; a drip cup associated with said applicator roll and fitted displacably onto said stick; and a spring device operatively associated with said drip cup, wherein: said drip cup comprising and opening traversed by said stick, an a pipe socket projecting from said opening and enclosing said stick, said pipe socket being shorter than said stick; said drip cup is retractable from a working position in which it encloses a stick-sided peripheral area of the applicator roll to a release position in which the applicator roll is pushed out of said drip cup, and vice-versa; said drip cup is supported on said stick in a self-locking way by a frictional force which may be overcome manually and said pipe socket is provided in the area of its rear end with a conically reduced extension wherein: said drip cup is provided with inner transverse ribs being provided at their upper edge with a central notch with which the bracket carrying said applicator roll may be engaged with a portion of said bracket extending towards said stick.

12. A device for applying paint onto surfaces, comprises: a stick; a bracket fitted on said stick; an applicator roll rotatbly supported on said bracket; a drip cup associated with said applicator roll and fitted displacably onto said stick; and a spring device operatively associated with said drip cup, wherein: said drip cup comprising an opening traversed by said stick, and a pipe socket projecting from said opening and enclosing said stick, said pipe socket being shorter than said stick; said drip cup is retractable from a working position in which it encloses a stick-sided peripheral area of the applicator roll to a release position in which the applicator roll is pushed out of said drip cup, and vice-versa; said drip cup is supported on said stick in a self-locking way by a frictional force which may be overcome manually and said pipe socket is provided in the area of its rear end with a conically reduced extension wherein: said drip cup is provided with a collar surrounding said opening, projecting into an inner space of said drip cup and being formed as an extension of said pipe socket which is provided with notches opposing each other in a longitudinal direction of said applicator roll and into which said bracket carrying said applicator roll may be inserted with a portion of said bracket adjacent to said stick.

13. A device for applying paint onto surfaces, comprises: a stick; a bracket fitted on said stick; an applicator roll rotatbly supported on said bracket; a drip cup associated with said applicator roll and fitted displacably onto said stick; and a spring device operatively associated with said drip cup, wherein: said drip cup comprising an opening traversed by said stick, and a pipe socket projecting from said opening and enclosing said stick, said pipe socket being shorter than said stick; said drip cup is retractable from a working position in which it encloses a stick-sided peripheral area of the applicator roll to a release position in which the applicator roll is pushed out of said drip cup, and vice-versa; said drip cup is supported on said stick in a self-locking way by a frictional force which may be overcome manually and said pipe socket is provided in the area of its rear end with a conically reduced extension wherein: said drip cup comprises at least one inner bottom-sided transverse rib; and on at least one transverse rib a saddle forming said stop element may be clipped detachably, said saddle being provided with a central notch associated with the bracket.

* * * * *